US007980410B2

(12) United States Patent
De Muinck

(10) Patent No.: US 7,980,410 B2
(45) Date of Patent: Jul. 19, 2011

(54) FOLDABLE BAG AND COMBINATION OF A CONTAINER AND A BAG AND METHOD FOR THE USE OF THIS COMBINATION

(75) Inventor: Ebo Jacques De Muinck, Loenen Aan De Vecht (NL)

(73) Assignee: SMQ Group B.V., Loenen Aan De Vecht (NL)

( * ) Notice: Subject to any disclaimer, the term of this patent is extended or adjusted under 35 U.S.C. 154(b) by 740 days.

(21) Appl. No.: 10/565,033

(22) PCT Filed: Jul. 18, 2003

(86) PCT No.: PCT/NL03/00533

§ 371 (c)(1),
(2), (4) Date: Jan. 17, 2006

(87) PCT Pub. No.: WO2004/022440

PCT Pub. Date: May 18, 2004

(65) Prior Publication Data

US 2006/0180589 A1 Aug. 17, 2006

(30) Foreign Application Priority Data

Sep. 5, 2002 (NL) ..... 1021401

(51) Int. Cl.
*B65D 25/14* (2006.01)

(52) U.S. Cl. ..... 220/495.06

(58) Field of Classification Search ..... 220/495.06, 220/495.05, 495.01, 23.86, 23.83, 723, 720, 220/495.03, FOR. 122, FOR. 120, FOR. 116, 220/FOR. 115, FOR. 112, 678, 677, 613, 220/612, 610, 62.22, 62.11, FOR. 103, FOR. 128; 206/577, 223, 216; 383/120, 88, 66; D9/720, D9/715; 229/103.3, 103, 117.34, 117.33, 117.27, 119, 121; *B65D 88/12, 5/60*
See application file for complete search history.

(56) References Cited

U.S. PATENT DOCUMENTS 2,556,661 A * 6/1951 Rendall et al. ..... 229/121
(Continued)

FOREIGN PATENT DOCUMENTS

DE U931620 8/1955
(Continued)

OTHER PUBLICATIONS

International Preliminary Examination Report of the European Patent Office for PCT/NL03/00533, filed Jul. 18, 2003.

(Continued)

*Primary Examiner* — Anthony Stashick
*Assistant Examiner* — Robert J Hicks
(74) *Attorney, Agent, or Firm* — Steven M. Koehler; Westman, Champlin & Kelly, P.A.

(57) ABSTRACT

The invention relates to a foldable bag that can be unfolded from an essentially flat initial state into an unfolded final state, provided with at least a first, a second and a third sheet for forming, respectively, a first, a second and a third wall of the foldable bag. The first sheet is joined to the second sheet via the third sheet, which third sheet in the initial state is folded along a fold line, wherein the fold line in the initial state is between the first and the second sheet. The foldable bag furthermore has an opening in the first sheet. The fold line of the third sheet in the initial state extends underneath the opening to form a channel between the first and second sheet past the opening. The invention furthermore relates to a combination of a container and empty bag as well as method for the use thereof, wherein the bag is fixed to the peripheral wall of the container by means of a first and a second fixing.

18 Claims, 4 Drawing Sheets

U.S. PATENT DOCUMENTS

Figure 1A:
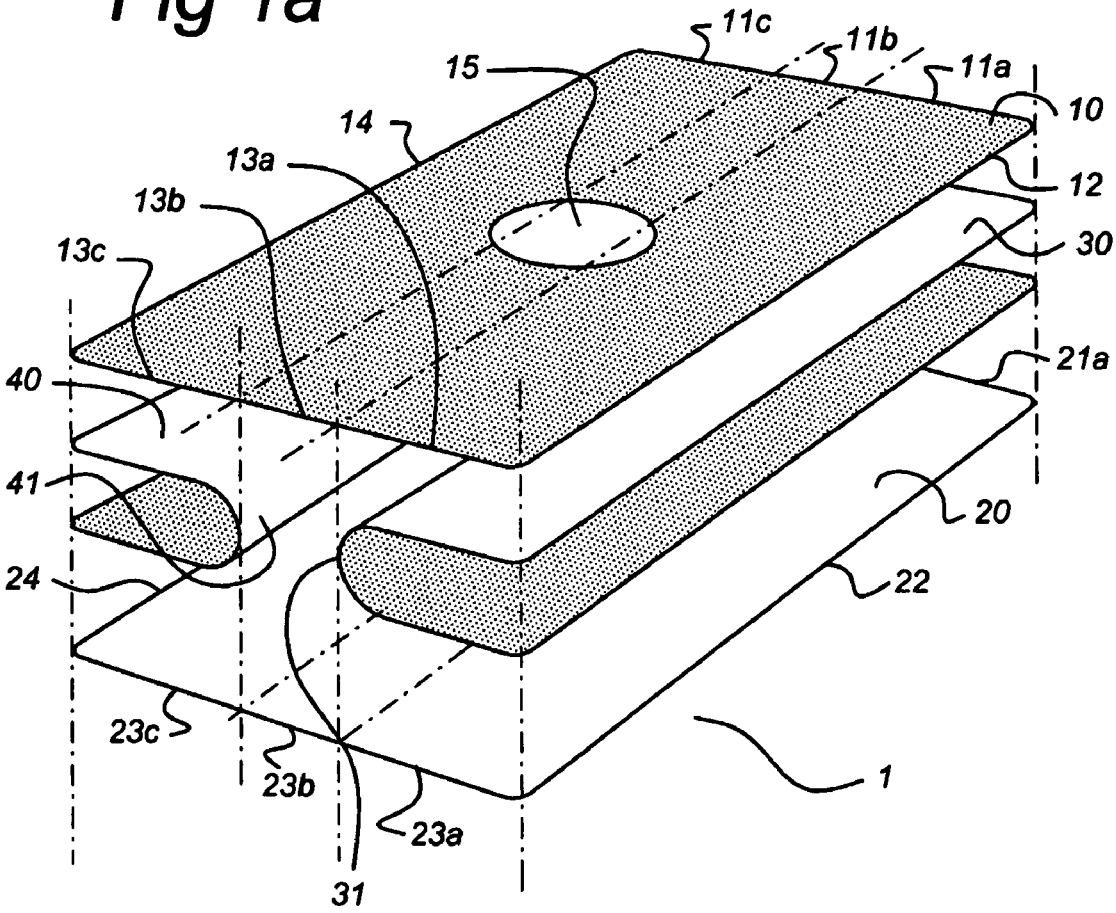

| | | | | | |
|---|---|---|---|---|---|
| 2,556,707 | A | * | 6/1951 | Rendall et al. | 229/121 |
| 3,089,622 | A | * | 5/1963 | Westlake, Jr. | 222/183 |
| 3,496,059 | A | | 2/1970 | Ole-Bendt | |
| 3,827,341 | A | | 8/1974 | Stage | |
| 3,942,416 | A | | 3/1976 | Ackley et al. | |
| 5,673,664 | A | * | 10/1997 | Lassanske | 123/196 R |
| 5,752,613 | A | | 5/1998 | Sasaki et al. | |
| 5,759,144 | A | * | 6/1998 | Derby | 493/197 |
| 5,788,121 | A | * | 8/1998 | Sasaki et al. | 222/105 |
| 5,788,122 | A | | 8/1998 | Keller | |
| 5,851,072 | A | * | 12/1998 | LaFleur | 383/66 |
| 5,918,984 | A | * | 7/1999 | LaFleur et al. | 383/8 |
| 5,988,422 | A | * | 11/1999 | Vallot | 220/62.22 |
| 6,032,818 | A | | 3/2000 | Olson | |
| 6,056,681 | A | | 5/2000 | Ross | |
| 6,062,431 | A | | 5/2000 | Geshay | |
| 6,139,482 | A | * | 10/2000 | Lafleur | 493/217 |
| 6,293,432 | B1 | | 9/2001 | Hartwall | |
| 2009/0297073 | A1 | | 12/2009 | Sondaar | |

FOREIGN PATENT DOCUMENTS

| | | | | |
|---|---|---|---|---|
| DE | 4204902 | A1 | * | 8/1992 |
| DE | 4316865 | A1 | * | 11/1993 |
| DE | U9316120.4 | | | 1/1994 |
| DE | 10214712 | A1 | | 10/2003 |
| EP | 0493332 | | | 7/1992 |
| EP | 0642453 | B1 | | 7/1992 |
| GB | 540564 | A | | 10/1941 |
| GB | 2117736 | | | 10/1983 |
| JP | 02191171 | A | * | 7/1990 |
| WO | WO 93/13936 | | | 7/1993 |
| WO | WO 93/24389 | | | 12/1993 |
| WO | WO9324389 | | | 12/1993 |
| WO | WO 2004/022440 | | | 3/2004 |

OTHER PUBLICATIONS

International Search Report of the European Patent Office for PCT/NL03/00533, filed Jul. 18, 2003.

Official Search Report of the European Patent Office Patent Office in counterpart foreign application No. PCT/NL2006/050133 filed Jun. 2, 2006.

Written Opinion of the European Patent Office Patent Office in counterpart foreign application No. PCT/NL2006/050133 filed Jun. 2, 2006.

* cited by examiner

FOLDABLE BAG AND COMBINATION OF A CONTAINER AND A BAG AND METHOD FOR THE USE OF THIS COMBINATION

CROSS-REFERENCE TO RELATED APPLICATION

The present application is a Section 371 National Stage of International patent application Serial No. PCT/NL03/00533, filed Jul. 18, 2003, published Mar. 18, 2004 as WO 2004/022440 in English.

BACKGROUND OF THE INVENTION

The discussion below is merely provided for general background information and is not intended to be used as an aid in determining the scope of the claimed subject matter. According to a first aspect the invention relates to a foldable bag that can be unfolded from an essentially flat initial state into an unfolded final state, provided with at least a first, a second and a third sheet for forming, respectively, a first, a second and a third wall of the foldable bag, wherein the first sheet is joined to the second sheet via the third sheet, which third sheet in the initial state is folded along a fold line, wherein the fold line of the third sheet in the initial state is between the first and the second sheet and wherein the foldable bag has at least one opening for filling and/or emptying the foldable bag.

A bag according to the preamble is known in the state of the art. The known bag is, for example, used for transporting, for example, fluids and paste-like products. The foldable bag is usually used in combination with a cube-shaped housing, such as a holder or a container, the top of which is open. The bag is placed in the housing in the folded state and then filled with a product via an opening in the wall of the bag. As a consequence of this the bag will unfold and fill the space in the housing. The filled bag is supported by the walls of the housing. The filled bag is transported together with the housing to the end user. The end user empties the bag and throws it away. The housing can be re-used.

The known bags, which are also termed pillow bags, generally consist of two rectangular sheets lying on top of one another which are joined to one another at the edges. The bag furthermore also has a first opening for filling the bag and optionally also a second opening for emptying the bag. Since the bag in the filled state is not cube shaped, bags must be used which have an internal volume in the filled state that is much greater than the internal volume of the housing. This is needed to ensure that the housing can be filled to the optimum possible extent. Before the bag is filled, the bag is draped over the housing or stuffed in the housing. Consequently an unnecessarily large amount of material is needed to produce these bags.

When such bags are emptied by means of suction it is possible that product that is in folds and/or corner points of the bag does not come out with the rest. When emptying the bag by means of suction it is also possible that a so-called collapse occurs. In this case part of the wall that is directly opposite the opening is sucked against the opening on the inside. This phenomenon occurs in particular once the bag has been sucked virtually empty. As a result the opening is closed off and no further product can leave the bag.

In the state of the art it is known to use foldable bags for transporting pastes or creams. When emptying by means of suction a few percent can be left in the bag. Bags are known which can take 1000 kg of paste or cream. If the paste or cream has a high price per kilogram, the portion that is left in the bag in the bag can represent a high value. Moreover, the material of such a bag in which the paste or cream is left is designated chemical waste. If better emptying of the bag were to be possible, the bag could be disposed of as ordinary waste.

As far as patent publications are concerned, reference can be made to U.S. Pat. No. 6,062,431; U.S. Pat. No. 5,788,121; U.S. Pat. No. 5,988,422 and DE-U 93.16.20.

U.S. Pat. No. 6,062,431 discloses a combination of a cardboard box with a bag for a fluid therein. This bag is of undefined shape and has a tap and filler cap. The filler cap is concealed under the lid of the box and the tap is in the box so that it can be pulled out from the box if tapping is desired.

U.S. Pat. No. 5,788,121 discloses a foldable bag made up of a first and second sheet with a folded third and fourth sheet between them, the fold lines of the latter facing one another. The sheets are joined to one another at the bottom and top by means of oblique seals in such a way that in the filled state the bag has a block shape, the fill/tap opening being provided in the top face of the block shape.

U.S. Pat. No. 5,988,422 discloses a foldable bag similar to that in U.S. Pat. No. 5,788,122. Here fill/tap openings are provided in both the top face and the bottom face of the block shape. DE-U 93.1620 discloses a foldable bag with a first, a second, a third and a fourth sheet, just as described in U.S. Pat. No. 5,788,122. In this case, however, the design is not such that the bag is block-shaped in the filled state; rather, it is tubular.

SUMMARY OF THE INVENTION

This Summary and Abstract are provided to introduce some concepts in a simplified form that are further described below in the Detailed Description. This Summary and Abstract are not intended to identify key features or essential features of the claimed subject matter, nor are they intended to be used as an aid in determining the scope of the claimed subject matter. In addition, the description herein provided and the claimed subject matter should not be interpreted as being directed to addressing any of the short-comings discussed in the Background. The aim according to the first aspect of the invention is to provide a bag of the type described in the preamble that is so constructed that it can be used, and in particular emptied, in an efficient manner. Said aim is achieved in that the opening is made in the first sheet and in that the fold line of the third sheet in the initial state extends underneath the opening to form a channel between the first and second sheet past the opening. The channel ensures that when the bag is emptied the second sheet cannot be sucked against the first sheet and thus close off the opening. Because the fold line runs underneath the opening this prevents the possibility of the opening being sucked against the second sheet sealing it off completely. The intermediate fold in the third sheet ensures unevenness and thus the presence of a chink.

It is pointed out that bags are known in the state of the art where strips, such as, for example, plastic strips are fitted in the interior of the bag. These strips form a channel that is in open communication with the opening. However, fitting such strips has the effect of increasing the costs and forms a channel that extends only over that part of the bag where the strips have been fitted.

An aspect of the invention further relates to a foldable bag which furthermore contains a fourth sheet for forming a fourth wall of the foldable bag, wherein the first sheet is joined to the second sheet via the fourth sheet, which fourth sheet in the initial state is folded along a fold line, wherein the fold line in the initial state is between the first and the second sheet, and wherein the fold line of the fourth sheet in the initial state extends underneath the opening to form a channel between the first and second sheet past the opening. The addition of the fourth sheet makes possible a foldable bag that has a greater capacity. Moreover, the fold line in the fourth sheet will strengthen and enlarge the channel and even further counteract shutting off resulting from suction of the second sheet against the opening.

An aspect of the invention furthermore relates to a foldable bag in which the opening has been made close to the longitudinal center line of the first sheet, wherein the fold lines in the third and optionally fourth sheet in the initial state extend essentially parallel to and close to said longitudinal center line. The positioning of the opening close to the longitudinal center line makes uniform filling and emptying of the foldable bag possible. Furthermore, the channel will extend over the entire length of the foldable bag, which is beneficial for emptying of the bag.

As aspect of the invention furthermore relates to a foldable bag where the distance between the fold line in, respectively, the third and fourth sheet in the initial state is less than 90%, preferably less than 80%, of the diameter of the opening. Such a construction has the advantage that the channel connects to the opening in an optimum manner.

As aspect of the invention furthermore relates to a foldable bag wherein the first sheet is provided with a first and a second opening for, respectively, filling and emptying the foldable bag. This makes it possible to fill the bag via the first opening, which is preferably located at the top, and to empty the bag by means of suction via the second opening, which is preferably located at the bottom.

An aspect of the invention furthermore relates to a foldable bag which is constructed as a gusset bag, wherein the first and the second sheet are essentially rectangular, each with two end edges and two side edges and wherein the first and the second sheet are each joined to the third and the fourth sheet via seals that run obliquely with respect to the side edges of the first and the second sheet, respectively, wherein the seals for joining the sheets extend from the end edges to the side edges. This has the advantage that in the unfolded state the bag will acquire a shape that approximately corresponds to rectangular constructions such as a cube, so that only a minimum amount of material is needed to produce the foldable bag. Such a bag can easily and advantageously be used in combination with a corresponding rectangular housing.

As aspect of the invention furthermore relates to a foldable bag wherein at least the first opening is made in the first sheet, at a join line between the points of contact of the oblique seals with the side edges of the first sheet. Preferably, a said at least one opening will be provided at both said join lines. This makes it possible to connect the various openings, even before filling the bag, to connection points suitable for this purpose, such as a fill hose and a suction hose. By this means it also becomes possible by means of the connection points to hold the bag flat between the connection points during filling and/or emptying, which is beneficial for the filling process and the emptying process, respectively.

An aspect of the invention furthermore relates to a foldable bag, the opening of which is constructed as cylindrical housing provided with a flange at the bottom thereof, for fixing said housing to the first sheet, wherein the fold line in the third sheet in the initial state extends underneath said flange to form a channel between the first and the second sheet towards said flange.

According to a second aspect the invention relates to a combination comprising a container and an empty bag that can be unfolded from a flat, empty state into a filled final state; wherein the container has a frame that defines a container chamber, which frame comprises a base and a peripheral wall that is upright in the height direction from the base; wherein the bag has at least one opening for filling and/or emptying the bag; and wherein the foldable bag in the filled final state has dimensions that essentially correspond to those of the container chamber.

As has already been discussed above, such a combination is already known per se, for example from U.S. Pat. No. 6,062,431 and also from other sources. According to an aspect of the invention and also according to the state of the art here the container can have solid walls, such as, for example, in the case of a cardboard box, but the walls can equally well be open, for example constructed from mesh or bars.

The problem that arises with such combinations according to an aspect of the invention is that either the bag is filled with the desired filling before it is placed in the container chamber, which is time-consuming and demands the requisite handling operations, or the bag is first placed in the container chamber and the desired filling is then placed in the bag. In the latter case it must be borne in mind that if the bag is not properly positioned in the container chamber the bag will be incompletely or poorly filled. If, for example, a portion of the bag is folded over, for example at the base, it will then be barely possible or will be impossible to fill this folded-over portion with filling if it is pressed against the walled enclosure, in the said example the base of the walled enclosure, by a portion that has already been filled. This can be prevented per se, but this always demands manipulation during filling by an operator who tugs on the bag during filling to prevent the occurrence of such flattened, unused parts of the bag. A further disadvantage of such combinations arises during discharging, or in other words emptying, of the bag. The latter can create a vacuum without it being completely empty because part of the wall of the bag is sucked against the discharge opening. If the bag has not been completely filled because of flattened parts of the bag, the risk of this phenomenon only becomes greater.

According to the second aspect, the aim of the present invention is to provide an improved combination that does not display the abovementioned disadvantages. Said aim is achieved with a combination comprising a container and an empty bag, which can be unfolded from a flat, empty state into a filled final state, wherein the container has a walled enclosure that defines a container chamber, which walled enclosure comprises a base and a peripheral wall that is upright in the height direction from the base, wherein the bag has at least one opening for filling and/or emptying the bag, wherein the unfoldable bag in the filled final state has dimensions that essentially correspond to those of the container chamber, achieved according to the second aspect of the invention in that the bag—in the flat, empty state—is fixed to the container against the walled enclosure by a first fixing and a second fixing located above the first fixing viewed in the height direction; and in that the first fixing is provided at the base and the second fixing is provided at the top of the peripheral wall such that, between the first and second fixing, the bag is in contact with the peripheral wall over essentially the entire height of the peripheral wall. What is achieved in this way is that the bag, before filling, assumes a fixed position in the container and specifically a position in which the bag is held in place along a sector—between the first and the second fixing—in contact with the peripheral wall—that can run vertically but also at an angle with respect to the vertical. In this way, trapping of certain portions of the bag by the bag between the bag itself and the walled enclosure during filling, as a consequence of which those portions are not filled or are incompletely filled, is prevented, or at least counteracted. The manipulation required in the case of the usual filling of the bag in the container chamber can be completely dispensed with in this case, or at least much less manipulation will be needed.

In this context it is further advantageous according to an aspect of the invention if the first or second fixing encompasses a said at least one opening. If there are two of said at least one openings, the first and second fixing will preferably each encompass a said at least one opening.

This offers advantages from the constructional engineering standpoint since in the case of a said at least one opening the bag will have been provided with a connection stub. The connection stub can then be used for inserting through the walled enclosure and pulling the bag against the walled enclosure on the inside, for example by screwing a ring around the connection stub on the outside or in some other way. A further constructional advantage is that the bag will already have been reinforced at the location of the connection stub to prevent the connection stub breaking away or tearing away from the bag. The advantage of this embodiment lies, however, not only in the construction. The advantage also lies in the fact that the bag can be completely filled and also that subsequently the bag can be completely emptied. After all, by filling the bag via the first or second fixing or optionally at the first or second fixing, the risk that a portion of the bag ends up lying on another portion of the bag at the start of filling and that ultimately one part of the bag remains unused or used to a lesser extent is appreciably reduced. The reverse is the case when emptying, i.e. the risk that part of the bag comes into contact with the emptying opening, shutting off the latter, is reduced. It will be clear that in the case of an at least one opening in both the first and the second fixing that the second fixing—that is provided above the first fixing—will preferably be the fill opening and the first fixing, which is low, will preferably be the emptying opening.

According to an aspect of the invention it is furthermore advantageous if the bag is so arranged that during filling, with the container upright and from the flat, empty state, it unfolds from the first fixing along the base and from the base into the top of the container chamber. As a person skilled in the art will recognise, this can be implemented in diverse ways depending on the shape of the container chamber and thus also the shape of the bag by, in particular, constructing and/or folding the bag in a suitable manner. In the case of, for example, a block-shaped container chamber and a block-shaped bag this can easily be implemented by constructing the bag as a so-called gusset bag, which type has already been discussed above and will also be discussed in more detail below. In the case of a cylindrical, upright container the various features can, for example, be implemented by constructing the bag in accordance with FIG. 1, although a bag according to, for example, FIG. 2 can also be used in a cylindrical container in accordance with the invention. When filling the bag the filling will automatically sink to the bottom of the bag and first unfold the bottom of the bag over the base of the container chamber, the bag then being unfolded increasingly further in the height direction as filling increases until it is completely unfolded.

As already indicated, it is in particular advantageous according to an aspect of the invention if the combination comprises a bag comprising a first, a second, a third and a fourth sheet for forming, respectively, a first, second, third and fourth bag wall; wherein the first sheet is joined to the second sheet via the third and the fourth sheet; and wherein, in the flat empty state, the third and the fourth sheet are each folded along a fold line; wherein, in the flat, empty state, the fold line of the third sheet and the fold line of the fourth sheet are between the first and the second sheet facing one another; and wherein the first and second fixing and the at least one opening are provided on the first sheet. It should be clear that what is concerned here is that the first and second opening are jointly provided in one of the sheets; this could equally well be the second sheet. As will also be explained later, it is also pointed out that the so-called first, second, third and fourth sheet can be individual sheets that are joined to one another by means of welded seams, but that they can also be formed from a single tubular sheet in which fold seams are provided in suitable locations.

It is furthermore advantageous according to an aspect of the invention if the container chamber is essentially block shaped. The reason for this is that block shaped containers can, inter alia, be stored in a space-saving manner. In the case of a block-shaped container it is furthermore advantageous according to an aspect of the invention if the first and second sheet each have two mutually parallel side edges running in the height direction; wherein, on the one hand, the first sheet is joined together with the third and fourth sheet and, on the other hand, the second sheet is joined together with the third and fourth sheet at the tops and bottoms thereof along an oblique seal, viewed with respect to the side edges, such that in the completely filled state the seals essentially determine the diagonals of the bottom surface and the top surface of the bag.

In this context it is furthermore advantageous according to an aspect of the invention if a top rib/axis runs between the outward-pointing ends of the top oblique seals of the first sheet; if a bottom rib/axis runs between the outward-pointing ends of the bottom oblique seals of the first sheet; if the first fixing is provided at the bottom rib/axis; if the second fixing runs at the top rib/axis; and if, preferably, the at least one opening is provided at the bottom and/or top rib/axis. Such an essentially block-shaped bag is then fixed to the walled enclosure of the container chamber in the most optimum manner. With a view to emptying or filling, it is furthermore advantageous with this arrangement if the at least one opening is provided at the bottom and/or top rib/axis. This is practical with a view to emptying since the entire bag can be emptied well in this way—in the case of only one opening provided at the top rib/axis the combination can optionally be turned upside down for emptying—. With a view to filling it is advantageous if the at least one opening is provided at the top rib/axis since the bag can then be completely filled entirely without or virtually entirely without overpressure in the feed line. From both the constructional engineering and the functional standpoint, it is not necessary that the first and/or second fixing are provided precisely at the level of the bottom and/or top rib/axis. The Applicant has discovered that it suffices:

if the distance from, on the one hand, a second fixing and/or from an at least one opening provided at the top rib/axis to, on the other hand, the top rib/axis is at most 25% of the depth of the container chamber, viewed horizontally and transversely to the top rib/axis, which distance is preferably at most 15%, such as at most 10%, of said depth; and/or; if the distance from, on the one hand, the first fixing and/or from an at least one opening provided at the bottom rib/axis to, on the other hand, the bottom rib/axis is at most 25% of the depth of the container chamber, viewed horizontally and transversely to the bottom rib/axis, which distance is preferably at most 15%, such as at most 10%, of said depth.

With a view to a maximum filling capacity, it is furthermore advantageous according to an aspect of the invention if the walled enclosure of the container has a ceiling that delimits the container chamber from above and if a portion of the bag facing upwards in the filled final state is provided with a said at least one opening, which is preferably provided at the second fixing.

It is furthermore advantageous according to an aspect of the invention if a foldable bag corresponding to the first aspect of the invention is used in the combination according to the second aspect of the invention.

Figure 1B:
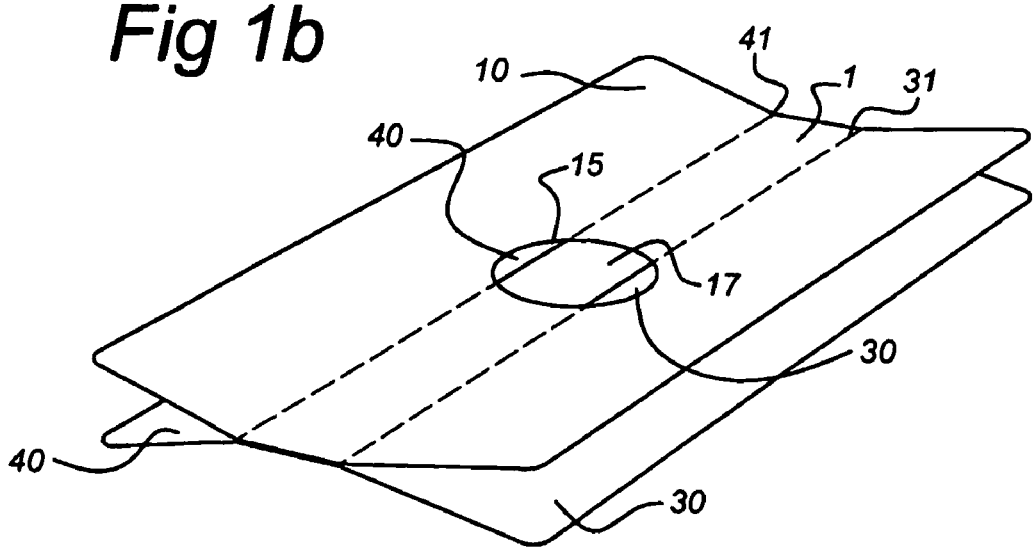
Figure 2:
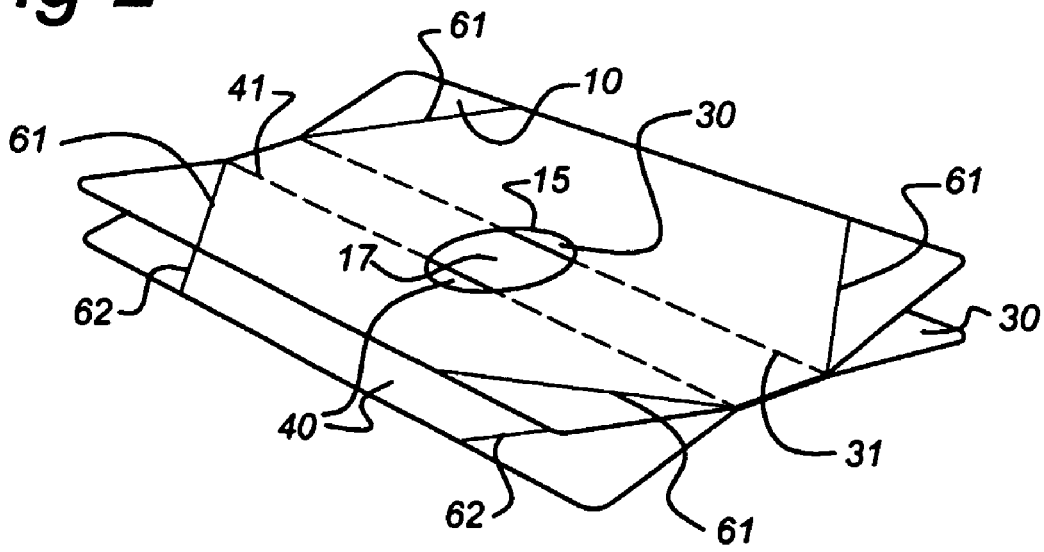
Figure 3:
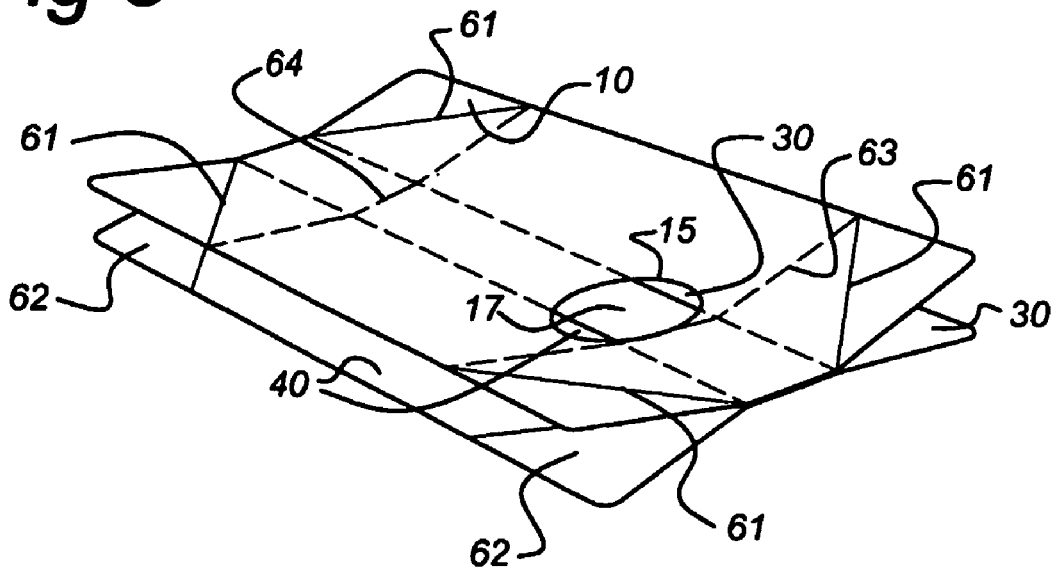
Figure 4A:
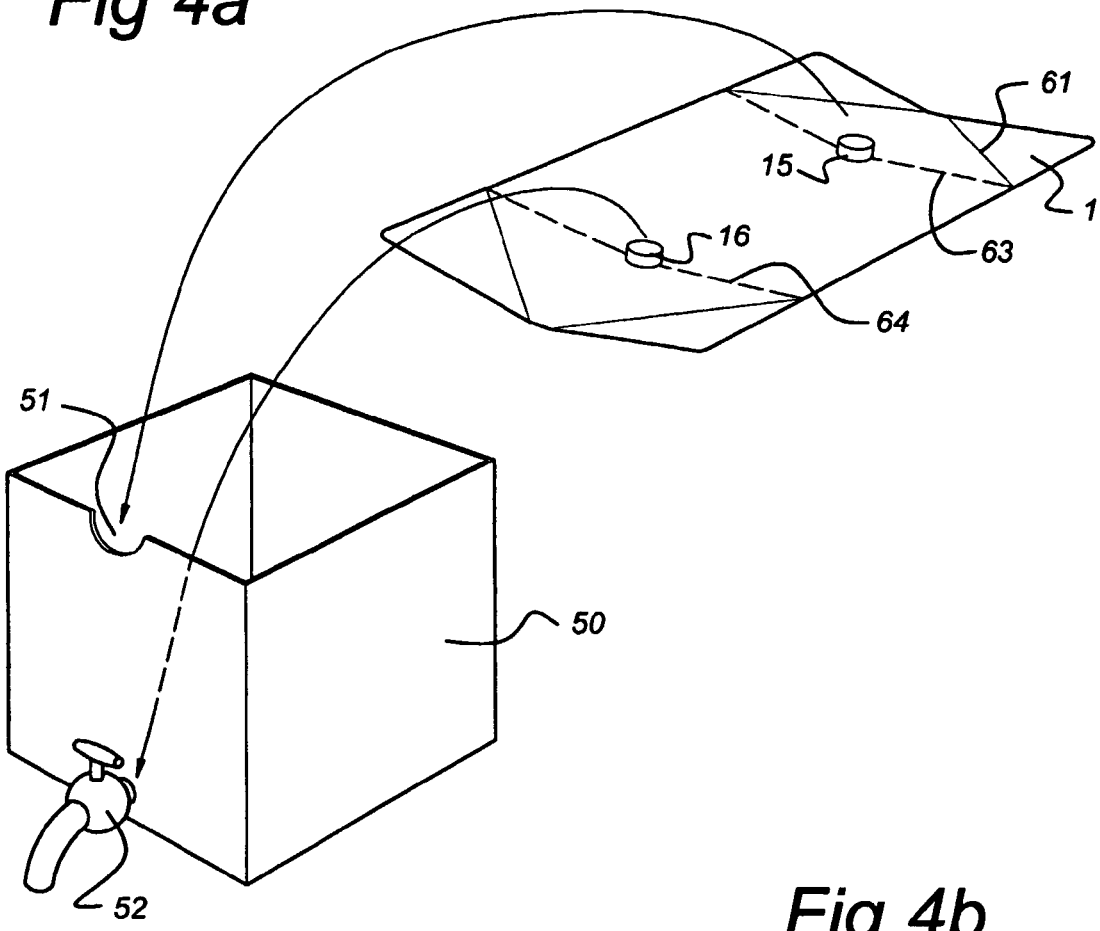
Figure 4B:
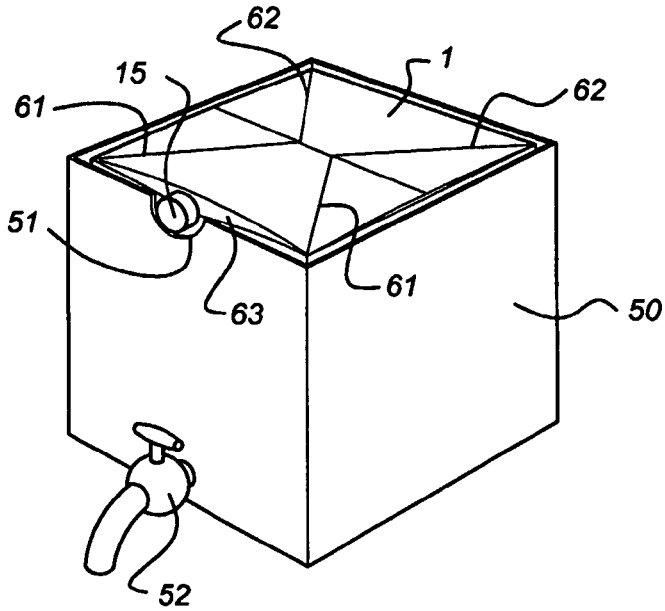

Aspects of the invention will be explained below with reference to a few drawings, in which:

FIGS. 1*a* and 1*b* show, diagrammatically, a foldable bag according to a first embodiment of the present invention, FIG. 2 shows, diagrammatically, a foldable bag according to a second embodiment of the present invention, FIG. 3 shows, diagrammatically, a foldable bag according to a third embodiment of the present invention, FIGS. 4*a* and 4*b* show, diagrammatically, a foldable bag in combination with a container, furthermore referred to as housing, according to a fourth embodiment of the present invention.

Figure 5A:
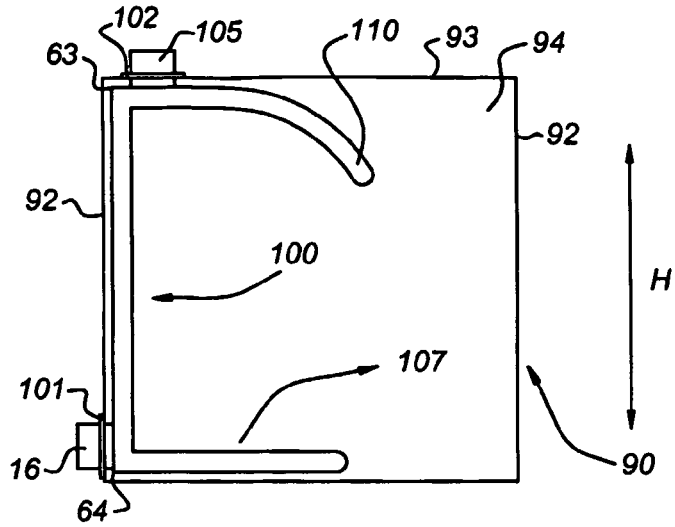
Figure 5B:
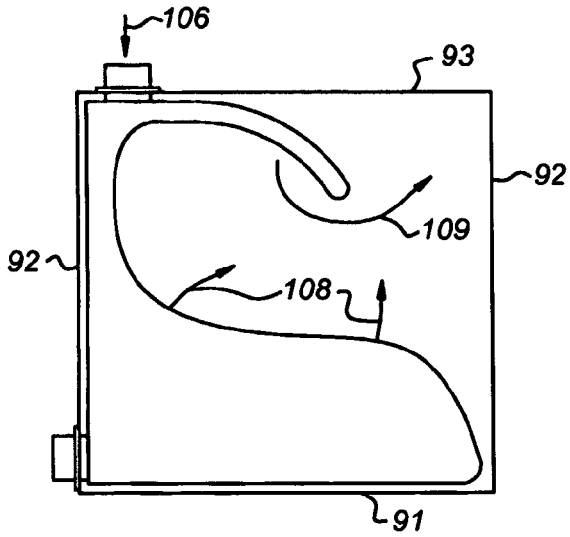
Figure 5C:
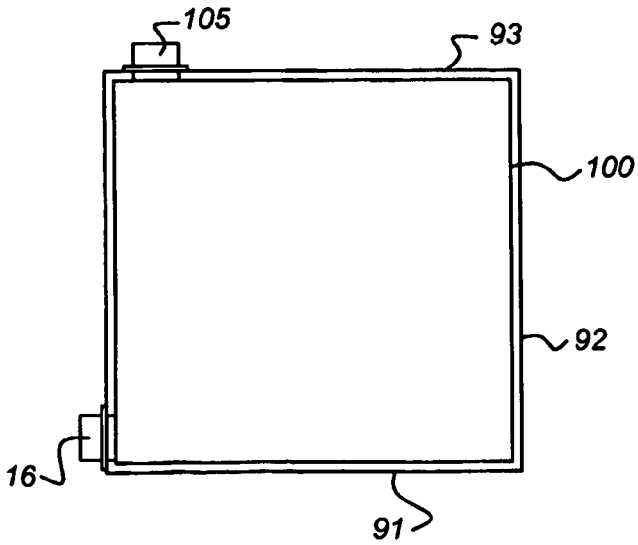

FIG. 5 shows a diagrammatic side view and cross-section of a combination according to the second aspect of the invention and the mode of operation when the bag thereof is unfolded, in an initial state (FIG. 5A), an intermediate state (FIG. 5B) and a final state (FIG. 5C).

DETAILED DESCRIPTION OF ILLUSTRATIVE EMBODIMENTS

FIG. 1*a* shows a foldable bag in the folded state. For the sake of clarity the various parts have been shown somewhat apart. The foldable bag 1 can be unfolded from an essentially flat initial state into an unfolded state. The foldable bag 1 consists of a first, a second, a third and a fourth sheet 10, 20, 30, 40. In the unfolded state of the foldable bag 1 these sheets form, respectively, a first, second, third and fourth bag wall. In the present text reference is made to a first, second, third and fourth bag wall. It must be understood that these various walls can be parts of one and the same sheet. In that case the walls, i.e. the first, second, third and fourth sheet, are joined to one another via fold lines. The first and second sheet 10, 20 are preferably rectangular and have the same shape and size and are delimited by, respectively, a first and second side edge 12, 14, 22, 24 and, respectively, a first and second end edge 11, 13, 21, 23. The end edges are preferably in each case divided in the same way into three sections a, b and c, for reasons which will be discussed later.

The third and fourth sheet 30, 40 are preferably also rectangular, of the same shape and of the same size. The third and fourth sheet 30, 40 have side edges of essentially the same size as the side edges of the first and second sheet 10, 20. The side edges of the third and fourth sheet 30, 40 are preferably shorter than the side edges of the first and second sheet 10, 20.

The third sheet 30 is joined along its boundary to the first and second sheet 10, 20 in such a way that the side edges of the third sheet 30 are joined to the first side edges 12, 22 of the first and second sheet 10, 20, respectively. The end edges of the third sheet 30 are furthermore joined to the first sections of the end edges 11*a*, 13*a*, 21*a*, 23*a* of the first and second sheet 10, 20. It can be seen from FIG. 1*a* that the third sheet is folded along a fold line 31 in such a way that in the initial state the third sheet 30 is in contact with the inside of the first and second sheet 10, 20.

The fourth sheet 40 is joined in a similar manner to the corresponding parts of the first and second sheet 10, 20. The fourth sheet 40 is also folded along a fold line 41 in such a way that the inside of the fourth sheet is in contact with the first and second sheet 10, 20. Finally, the second sections 11*b*, 13*b* of the first wall 10 and the corresponding second sections 21*b*, 23*b* of the second wall 20 are joined to one another.

It will be clear that the first and third sections of the end edges 11*a*, 11*c*, 13*a*, 13*c*, 21*a*, 21*c*, 23*a*, 23*c* of the first and second sheet 10, 20 essentially have a length that is half the length of the end edges of the third and fourth wall.

The length of the second sections 11*b*, 13*b*, 21*b*, 23*b* are so chosen that in the folded state the foldable bag has a channel 17, which extends through the middle of the foldable bag 1 in the direction parallel to the side edges of the foldable bag 1. The channel 17 is formed by a section of the first and second sheet 10, 20 and by the fold edges 31, 41 of the third and fourth sheet 30, 40. The channel 17 prevents part of the foldable bag 1, and in particular parts of the second sheet 20, being able to close off the opening 15 on the inside.

The foldable bag 1 furthermore has an opening 15, which, for example, is in the first sheet 10. The opening 15 is so positioned that it is essentially in front of the channel 17. The fold line 31 and/or the fold line 41 run underneath the opening 15, or in other words lie within the imprint of the opening 15. The opening 15 can be used to fill the foldable bag 1 with product and/or to empty it. FIG. 1*b* shows such a foldable bag 1, where the various parts are shown joined to one another.

The length of the second sections 11*b*, 13*b*, 21*b*, 23*b* must be so chosen, depending on the material characteristics of the material used for the sheets and the size of the opening 15, that the channel 17 and the communication therewith from the opening 15 is maintained even if a suction force is exerted on opening 15. If very flexible material is used, a relatively short length will preferably be chosen for the length of the second sections 11*b*, 13*b*, 21*b*, 23*b* so as to prevent the second sheet 20 being sucked against the opening 15 under the influence of a suction force on opening 15.

The opening 15 is preferably a circular opening, but can, of course, also have a square, oval or any other suitable shape.

The distance between the fold lines 31 and 41 of the third and fourth sheet 30, 40 can, for example be less than the diameter of the opening 15 and such that the fold lines both fall within the imprint of the opening.

It is customary to make the opening 15 from a cylindrical body that is provided with a flange on the underside thereof. The relatively large surface area of the flange is used to obtain good fastening of the opening 15 on the material of the first wall. Such an opening that is made from a cylindrical body provided with a flange on the underside is also termed a spout. It will be clear that the flange itself can also have such a shape that the flange acts as a spacer to form a channel in the direction of the outflow opening 15. In this case the distance between the fold lines of the third and the fourth sheet 30, 40 can remain relatively wide, so that the channel formed connects to the flange between the fold lines.

The sheets are preferably made of film, which can be made up of one or more layers, for example by means of co-extrusion or lamination. In this context the inner layer of the film preferably melts at a lower temperature than the outer layer. This makes it possible to join the various parts to one another by means of seals (welded seams). As will be understood by a person skilled in the art, it will be possible to make the foldable bag 1 as shown in a simple manner by means of a single seal stamp. This seal stamp can be pressed onto the foldable bag 1 and in a single action join both the first sheet 10 to the third and fourth sheet 30, 40 and also the second sheet 20 to the third and fourth sheet 30, 40. The parts of the third and fourth sheet 30, 40 that are in contact with one another will, however, not be joined by the seal stamp.

In the case of a laminate structure, the outer layer will be made from a non-weldable material and the inner layer from a weldable material.

Preferably use is made of a 1-layer multi-layer film. This has the advantage that no air inclusion can take place between the layers during production.

FIG. 2 shows, diagrammatically, a foldable bag 1 according to a second embodiment of the present invention. In this embodiment there are, in addition to the one in respect of the first embodiment described above, additional joins, in the form of seals, 61, 62, made at the corner points of the first (seals 61) and second (seals 62) sheet 10, 20. These seals 61, 62 run obliquely and with respect to the side edges of the first and the second sheet, respectively, the oblique seals 61, 62 for joining the sheets extending from the end edges to the side edges. The seals 61 join the first sheet 10 at its corners to the third and fourth sheet 30, 40 and correspondingly at the bottom seals 62 join the second sheet 20 to the third and fourth sheet 40. In so doing the oblique seals 61 and 62 close off a triangular section of the foldable bag 1. As will be understood by a person skilled in the art, as a consequence of these additional joins the foldable bag 1 in the unfolded state will assume a shape that has the shape of a rectangular, such as a cube or bar, more generally termed a block shape. Foldable bags with such oblique seals 61 are known by the name gusset bags.

FIG. 3 shows a third alternative embodiment of the foldable bag 1. In this embodiment the opening 15 is so positioned that when the foldable bag 1 is unfolded, for example by filling the foldable bag 1 with product, this opening 15 is essentially located on a rib 63 of the cube or bar shape then obtained. For this purpose the opening 15 is essentially positioned between the contact points of the oblique seals 61 with the side edges. This has the advantage that the opening 15 remains easily accessible to a user when filling the foldable bag 1 and/or emptying the foldable bag 1 by means of suction. By virtue of the positioning of the opening 15, a valve or tap element that may be fitted on the opening 15 can be easily operated by a user.

Finally, a fourth embodiment is shown in FIGS. 4*a* and 4*b*. Corresponding parts are indicated by the same reference numerals as in the preceding figures. A housing 50 is shown in FIGS. 4*a* and 4*b*. The housing 50 is provided with a first and second opening 51, 52. These openings can be so arranged that, on the one hand, they can be connected to openings in the wall of the foldable bag 1 and, on the other hand, can be connected to filling means, such as fill hoses, and suction means for emptying the foldable bag 1 by means of suction. It is also possible for the foldable bag 1 to be connected directly to the fill hoses and/or suction means. In said latter case the housing 50 only has openings 51, 52 to allow these connections through.

In this embodiment a second opening 16 is made in the foldable bag 1. This makes it possible, for example, to use the first opening 15 for filling the foldable bag 1 and to use the second opening 16 for emptying the foldable bag. The positioning of the openings 15, 16 can then be so chosen that the first opening, used for filling, is at the top of the foldable bag 1 and the second opening 16 is at the bottom of the foldable bag 1. With this arrangement the second opening 16 is preferably so positioned that it is essentially above the channel 17 when the foldable bag 1 is in the folded state. The two openings are preferably positioned between the points of the oblique seals 61 with the side edges of the sheets, that is to say the upper rib/axis (63) and the lower rib/axis (64), respectively, as can be seen in FIG. 4*a*. It will be clear that, depending on the material of the foldable bag, the openings have to be positioned a short distance away from the line 63, 64 between the points of contact of the oblique seals. If the material is relatively flexible and the openings are positioned precisely on the fold lines 63, 64, problems can arise when filling or emptying the bag.

The positioning of the first and second opening 15, 16 preferably takes place in such a way that these are the same distance apart when the foldable bag 1 is in the folded state as when the foldable bag 1 is in the unfolded state. This makes it possible to place the foldable bag 1 in the folded state in the housing 50 and to connect the openings 15, 16 to the corresponding openings in the housing 50 or optional filling and emptying means. In contrast to known foldable bags 1, it is not necessary first partially to fill the foldable bag 1, for example with air, in order to be able to connect the two openings 15, 16 to the corresponding openings 51, 52 in the housing. The bag can be fixed in the empty state to the housing 50 at the two openings 15, 16.

Consequently, the bag according to the invention is very suitable for applications where the contents of the bag have to remain sterile. Moreover, the bag according to the invention is therefore very suitable for applications where a fill nozzle has a restricted freedom of movement and, for example, cannot be pushed deeply into a container. It will be clear that the size of the foldable bag 1 can be made for a wide variety of housings and in a wide variety of sizes. It is, for example, possible to produce a bag for use in a housing with a capacity of 2 litres or for use in a sea container.

It will be clear that the embodiment of the first aspect of the invention described above has been described solely by way of example and not with any restrictive significance and that various changes and modifications are possible without going beyond the core of the invention and that the scope of protection of the first aspect is determined solely by the appended Claims. It will also be clear that the embodiment described with reference to FIG. 4 is not only in accordance with the first aspect of the invention but is also in accordance with the second aspect of the invention if connection stubs 15 and 16 are fixed to the container 50 when the bag is empty.

The second aspect of the invention will be discussed in more detail somewhat more specifically below with reference to FIGS. 5A to 5C. FIGS. 5A to 5C show, diagrammatically in cross-section, a side view of a combination according to the invention. In FIG. 5 a container is indicated by 90. This container has a walled enclosure 91, 92, 93. The walled enclosure comprises a base 91, an upright peripheral wall 92 and a ceiling 93. The walled enclosure 91, 92, 93 delimits a container chamber 94. In FIG. 5 a bag 100 is shown that, except for the position in which the inlet opening 15 is fixed, essentially corresponds to the bag as shown in FIGS. 4A, 4B. The bag has been folded along an upper rib/axis 63 and a lower rib/axis 64 to give a U shape. The vertical height (in the direction according to double-headed arrow H) of the section of the bag 100 located between the fold line 64 and fold line 63 is approximately equal to the vertical height of the container chamber 94. The connection stub 16 firmly attached to the bag 100 has been inserted through the upright wall 92 at the bottom and secured on the outside by means of a retaining member 101. This retaining member 101 can, for example, be a nut, but also a U-shaped bracket that has been pushed around the stub 16.

The bag is provided at the top with a connection stub 105, which, except for the position of fixing, does not differ essentially from the connection stub 15 in FIG. 4A. This connection stub 105 has been firmly attached to the bag 100 and pushed through the ceiling 93 and secured to the ceiling 93 by means of a fixing member 102, for example a nut or a bracket.

What is achieved by the fact that the connection stub 16 is provided at the lower rib/axis 64 and the connection stub 105 is provided at the upper rib/axis 63 and by the fact that the vertical height of the bag 100 between said rib axes is approximately equal to the vertical height of the container chamber is that, after fixing in the empty state, the bag is in contact with the peripheral wall over essentially the entire height of the peripheral wall in the zone between the connection stubs 106 and 105.

If the bag is now filled, as is indicated by means of arrow 106 in FIG. 5B, the filling, for example water, will then flow downwards and collect in the bottom of the bag 100. The bag 100 will then flap open at the bottom, as is indicated by means of arrow 107 in FIG. 5A, and, as is indicated by means of arrows 108 in FIG. 5C, will then swell up in the upward direction. As soon as the bag has been filled to a sufficient extent, the bag will also start to flap open at the top, as is indicated by means of arrow 109, and finally will become completely filled, as is shown in FIG. 5C.

If the preferred bag as discussed with reference to FIGS. 1, 2, 3 and 4 is used it is particularly ensured that the filling will collect in the bottom of the bag at the start of filling, if this takes place from above. Specifically, the channel 17 ensures that the filling is easily able to collect in the bottom of the bag. By providing the connection stub 105 as close as possible to the upper rib/axis 63 the risk of the filling collecting in Section 110—see FIG. 5A—of the bag is kept low. This risk can be even further minimised by holding the section 110 more against the ceiling 93, optionally by temporarily holding it by means of a fixing member or optionally by hand.

When the bag is allowed to empty, for example via connection stub 16, the bag will essentially undergo a movement that is the reverse of that when filling. The channel 17 then offers an advantage in emptying the bag completely. The channel 17 and also the fact that the fold seams 31 and 41 run underneath the opening of the connection stub 16—FIG. 2—then furthermore ensure that the opening at the connection stub 16 is not sucked closed prematurely.

Within the scope of the invention according to the first and/or second aspect the fill opening can also be provided approximately centrally in the top of the bag, for example in the case of FIG. 4*b* at the join line halfway between the oblique welded seams 61. 15 can then optionally function solely as fixing means and then does not have to have an opening. Essentially the same applies for FIG. 5.

The invention claimed is:

1. A combination comprising a container and an empty bag that can be unfolded from a flat, empty state into a filled final state;

wherein the container has a walled enclosure that defines a container chamber, which walled enclosure comprises a base and a peripheral wall that is upright in a height direction from the base;

wherein the bag comprises a first, a second, a third and a fourth sheet for forming, respectively, a first, second, third and fourth bag wall;

wherein each of the sheets is rectangularly shaped, wherein the first and the second sheets are at least approximately the same size, and wherein the third and the fourth sheets are at least approximately the same size;

wherein the first sheet has a first end edge, a second end edge, a first side edge, and a second side edge, the first and the second end edges being divided into three sections, the three sections including a first outer section, a second outer section, and an inner section;

wherein the second sheet has a first end edge, a second end edge, a first side edge, and a second side edge, the first and the second end edges being divided into three sections, the three sections including a first outer section, a second outer section, and an inner section;

wherein the third sheet has a first end edge, a second end edge, a first side edge, and a second side edge;

wherein the fourth sheet has a first end edge, a second end edge, a first side edge, and a second side edge;

wherein, in the flat empty state, the third and the fourth sheet are each folded along a fold line;

wherein, in the flat, empty state, the fold line of the third sheet and the fold line of the fourth sheet are between the first and the second sheet facing one another;

wherein the fold lines extend essentially in the height direction of the container;

wherein the fold lines, the height direction of the container, and each of the side edges of the sheets are at least approximately parallel to each other and are at least approximately perpendicular to each of the end edges of the sheets;

wherein the first outer section of the first end edge or the first sheet is joined to the first end edge of the third sheet;

wherein the inner section of the first end edge of the first sheet is joined to the inner section of the first end edge of the second sheet;

wherein the second outer section of the first end edge of the first sheet is joined to the first end edge of the fourth sheet;

wherein the first outer section of the second end edge of the first sheet is joined to the second end edge of the third sheet;

wherein the inner section of the second end edge of the first sheet is joined to the inner section of the second end edge of the second sheet;

wherein the second outer section of the second end edge of the first sheet is joined to the second end edge of the fourth sheet;

wherein the first sheet of the bag is provided with a first opening for emptying the bag, the first opening being connected to the peripheral wall;

wherein the foldable bag in the filled final state has dimensions that essentially correspond to those of the container chamber;

wherein the first sheet of the bag is provided with a second opening for filling the bag;

wherein the first opening and second opening are fixed to the walled enclosure;

wherein the first opening is provided at the base of the container and the second opening is provided at the top of the peripheral wall such that, between the first opening and second opening, the bag is in contact with the peripheral wall over essentially the entire height of the peripheral wall as well that, with the container upright and from the flat, empty state, the bag unfolds from the first opening along the base and from the base into the top of the container chamber, wherein the fold line of the third sheet and the fold line of the fourth sheet in the initial state extend underneath the first opening to form a channel between the first and second sheet past the first opening, and wherein the bag is folded along an upper axis and a lower axis to define a U shape, with a bottom section of the bag that adjoins a base end of the channel and is configured to flap open around the lower axis and expand as it collects a first portion of liquid received in the bag.

2. The combination according to claim 1, wherein the container chamber is essentially block-shaped or cylindrical;

wherein the first side edge of the first sheet is joined to the first side edge of the third sheet;

wherein the second side edge of the first sheet is joined to the first side edge of the fourth sheet;

wherein the first side edge of the second sheet is joined to the second side edge of the third sheet; and wherein the second side edge of the second sheet is joined to the second side edge of the fourth sheet.

3. The combination according to claim 2, wherein a first oblique seal runs between the first outer edge of the first end edge of the first sheet and the first side edge of the first sheet, the first oblique seal joining the first sheet and the third sheet;

wherein a second oblique seal runs between the second outer edge of the first end edge of the first sheet and the second side edge of the first sheet, the second oblique seal joining the first sheet and the fourth sheet;

wherein a third oblique seal runs between the first outer edge of the second end edge of the first sheet and the first side edge of the first sheet, the third oblique seal joining the first sheet and the third sheet;

wherein a fourth oblique seal runs between the second outer edge of the second edge of the first sheet and the second side edge of the first sheet, the fourth oblique seal joining the first sheet and the fourth sheet;

wherein a fifth oblique seal runs between the first outer edge of the first end edge of the second sheet and the first side edge of the second sheet, the fifth oblique seal joining the second sheet and the third sheet;

wherein a sixth oblique seal runs between the second outer edge of the first end edge of the second sheet and the second side edge of the second sheet, the sixth oblique seal joining the second sheet and the fourth sheet;

wherein a seventh oblique seal runs between the first outer edge of the second end edge of the second sheet and the first side edge of the second sheet, the seventh oblique seal joining the second sheet and the third sheet;

wherein an eighth oblique seal runs between the second outer edge of the second end edge of the second sheet and the second side edge of the second sheet, the eighth oblique seal joining the second sheet and the fourth sheet; and wherein in the completely filled state the oblique seals determine diagonals of a bottom surface and a top surface of the bag.

4. The combination according to claim 3, wherein an upper axis runs between the first and the second oblique seals;

wherein a lower axis runs between the third and the fourth oblique seals;

wherein the first opening is provided at the lower axis; and wherein the second opening is provided at the upper axis.

5. The combination according to claim 4, wherein a distance from the second opening to the upper axis is at most 25% of the depth of the container chamber, viewed horizontally and transversely to the upper axis, wherein said distance is at most 15% of said depth.

6. The combination according to claim 4, wherein a distance from the first opening to the lower axis is at most 25% of the depth of the container chamber, viewed horizontally and transversely to the lower axis, wherein said distance is at most 15% of said depth.

7. The combination according to claim 1, wherein the walled enclosure of the container has a ceiling that delimits the container chamber from above and wherein a portion of the bag facing upwards in the filled final state is provided with the second opening.

8. The combination according to claim 7 wherein the first opening and the second opening are made on a longitudinal center line of the first sheet, wherein the fold lines in the third and fourth sheet in the initial state extend essentially parallel to and close to said longitudinal center line.

9. The combination according to claim 1, wherein a distance between the fold lines in, respectively, the third and fourth sheet in the initial state is less than 90%, preferably less than 80%, of the diameter of the opening.

10. The combination according to claim 1, wherein, viewed transversely to the fold line of the third sheet, a greatest distance to the periphery of of the first opening is at least 5% of the maximum passage width of said opening, viewed transversely to the fold line of the third sheet.

11. The combination according to claim 1, wherein, viewed transversely to the fold line of the fourth sheet, a greatest distance to the periphery of the first opening is at least 5% of the maximum passage width of said opening, viewed transversely to the fold line of the fourth sheet.

12. A method for the use of a combination comprising a container and an empty bag that can be unfolded from a flat, empty state into a filled final state;

wherein the container has a walled enclosure that defines a container chamber, which walled enclosure comprises a base and a peripheral wall that is upright in the height direction from the base;

wherein the bag comprises a first, a second, a third and a fourth sheet for forming, respectively, a first, second third and fourth bag wall;

wherein the first, the second, the third, and the fourth sheet are each made of a multilayer film, the multilayer film including an inner layer that melts at a lower temperature than an outer layer;

wherein the first sheet is joined to the second sheet via the third and the fourth sheet, the sheets being joined utilizing welded seams;

wherein, in the flat empty state, the third and the fourth sheet are each folded along a fold line;

wherein, in the flat, empty state, the fold line of the third sheet and the fold line of the fourth sheet are between the first and the second sheet facing one another;

wherein the fold lines extend essentially in the height direction of the container;

wherein the first sheet of the bag is provided with a first opening for emptying the bag, the first opening being connected to the peripheral wall;

wherein the foldable bag in the filled final state has dimensions that essentially correspond to those of the container chamber;

wherein the first sheet of the bag is provided with a second opening for filling the bag;

wherein the first sheet has a central longitudinal axis and the first and the second openings are positioned on the central longitudinal axis;

wherein the first opening and second opening are fixed to the walled enclosure, the first and the second openings each including a connection stub, the connections stubs being secured to the walled enclosure utilizing rings that are placed around the connection stubs from an outer wall of the wall enclosure;

wherein the first opening is provided at the base of the container and the second opening is provided at the top of the peripheral wall such that, between the first opening and second opening, the bag is in contact with the peripheral wall over essentially the entire height of the peripheral wall as well that, with the container upright and from the flat, empty state, the bag unfolds from the first opening along the base and from the base into the top of the container chamber, wherein the fold lines of the third sheet and the fourth sheet in the initial state extend underneath the first and the second openings to form a channel between the first and the second sheets past the first and the second openings;

wherein the first and the second openings are at least approximately circular, the first and the second openings having diameters that are larger than a width of the channel when the hag is in the flat empty state; and wherein the flat empty bag is first fixed at the first and second opening against the walled enclosure of the container chamber and only then is the bag filled with a filling via the second opening, and wherein the bag is folded along an upper axis and a lower axis to define a U shape, with a bottom section of the bag that adjoins a base end of the channel and is configured to flap open around the lower axis and expand as it collects a first portion of liquid received in the bag.

13. The method according to claim 12, wherein the bag is emptied via the first opening, and wherein the bag further it of seals made at corners of the first and the second sheets, the plurality of seals running obliquely and with respect to side edges of the first and the second sheets, the plurality of seals closing off triangular sections of the bag.

14. The method according to claim 12, wherein a final portion of the bag is emptied via the first opening.

15. The combination according to claim 1, in which the first opening and second opening are fixed to the walled enclosure by means that include connection stubs and retaining members.

16. A combination comprising a container and an empty bag that can be unfolded from a flat, empty state into a filled final state;

wherein the container has a walled enclosure that defines a container chamber, which walled enclosure comprises a base and a peripheral wall that is upright in the height direction from the base;

wherein the bag comprises a first, a second, a third and a fourth sheet for forming, respectively, a first, second, third and fourth bag wall;

wherein the first sheet has first and second end edges that are each divided into three sections, the three sections including one inner portion and two outer portions;

wherein the second sheet has first and second end edges that are each divided into three sections, the three sections including one inner portion and two outer portions;

wherein the first sheet is joined to the second sheet via the third and the fourth sheet;

wherein two of the six end edge sections of the first sheet are joined to the third sheet utilizing welded seams;

wherein another two of the six end edge sections of the first sheet are joined to the fourth sheet utilizing welded seams;

wherein the two inner edge sections of the first sheet are joined to the two inner edge sections of the second sheet utilizing welded seams;

wherein, in the flat empty state, the third and the fourth sheet are each folded along a fold line;

wherein, in the flat, empty state, the fold line of the third sheet and the fold line of the fourth sheet are between the first and the second sheet facing one another;

wherein the fold lines extend essentially in the height direction of the container;

wherein the first sheet of the bag is provided with a first opening for emptying the bag, the first opening being connected to the peripheral wall;

wherein the foldable bag in the filled final state has dimensions that essentially correspond to those of the container chamber;

wherein the first sheet of the bag is provided with a second opening for filling the bag;

wherein the first opening and second opening are fixed to the walled enclosure;

wherein the first opening is provided at the base of the container and the second opening is provided at the top of the peripheral wall such that, between the first opening and second opening, the bag is in contact with the peripheral wall over essentially the entire height of the peripheral wall as well that, with the container upright and from the flat, empty state, the bag unfolds from the first opening along the base and from the base into the top of the container chamber, wherein the fold line of the third sheet and the fold line of the fourth sheet in the initial state extend underneath the first opening to form a channel between the first and second sheet past the first opening, and wherein the fold line of the third sheet and the fold line of the fourth sheet in the initial state are separated from each other by a distance such that a majority of the diameter of the first opening lies between the fold line of the third sheet and the fold line of the fourth sheet in the initial state.

17. The combination according to claim 16, and further comprising at least one oblique seal that closes off a triangular section of the bag.

18. The method of claim 12 wherein the first sheet has first and second end edges that are each divided into three sections, the three sections including one inner portion and two outer portions; wherein the second sheet has first and second end edges that are each divided into three sections, the three sections including one inner portion and two outer portions; wherein two of the six end edge sections of the first sheet are joined to the third sheet utilizing welded seams; wherein another two of the six end edge sections of the first sheet are joined to the fourth sheet utilizing welded seams; and wherein the two inner edge sections of the first sheet are joined to the two inner edge sections of the second sheet utilizing welded seams.

* * * * *